United States Patent [19]

Woodmansee

[11] 4,154,582

[45] May 15, 1979

[54] METHOD OF SOLIDS DISCHARGE FROM COAL GASIFIER GRATE

[75] Inventor: Donald E. Woodmansee, Schenectady, N.Y.

[73] Assignee: General Electric Company, Schenectady, N.Y.

[21] Appl. No.: 883,716

[22] Filed: Mar. 6, 1978

Related U.S. Application Data

[62] Division of Ser. No. 820,798, Aug. 1, 1977, Pat. No. 4,098,586.

[51] Int. Cl.[2] ..... C10J 3/16; C10J 3/06

[52] U.S. Cl. ..... 48/210; 48/203; 252/373

[58] Field of Search ..... 48/63, 66, 68, 73, 76, 48/77, 85.2, 197 R, 202, 203, 206, 210; 110/167, 168, 169; 126/162; 201/34, 38; 252/373

[56] References Cited

U.S. PATENT DOCUMENTS

| | | | |
|---|---|---|---|
| 2,185,077 | 12/1939 | Galusha | 48/68 |
| 2,440,940 | 5/1948 | Galusha | 48/76 |
| 2,816,823 | 12/1957 | Galusha | 48/76 |
| 2,933,057 | 4/1960 | Wilson | 126/162 |
| 3,454,382 | 7/1969 | Hamilton | 48/76 |
| 3,847,562 | 11/1974 | Hamilton | 48/76 |

*Primary Examiner*—S. Leon Bashore
*Assistant Examiner*—Peter F. Kratz
*Attorney, Agent, or Firm*—Leo I. MaLossi; Joseph T. Cohen; Charles T. Watts

[57] ABSTRACT

A method is described for the discharge of solids from a coal gasifier grate at different radial locations.

2 Claims, 7 Drawing Figures

METHOD OF SOLIDS DISCHARGE FROM COAL GASIFIER GRATE

This is a division of application Ser. No. 820,798, filed Aug. 1, 1977 now U.S. Pat. No. 4,098,586.

BACKGROUND OF THE INVENTION

This invention relates to grate construction for a fixed bed coal gasifier. In the fixed bed coal gasification process, coal enters the gasifier at the top and lands on top of the charge of coal already in the gasifier where it receives heat from the upwardly-moving product gas. As the combustion process near the bottom of the gasifier (above the grate) consumes some of the coal and the rest of the coal is gasified, coal at the top of the charge gradually moves down, passing through a series of treatment stages: initial heating; devolatilization and coking; gasification, and carbon oxidation. A large number of chemical reactions occur and a minimum temperature of about 1700°-1900° F. is required. Usually the gasification is conducted under superatmospheric pressure. When air and steam are introduced to the combustion zone, the end product is producer gas; when oxygen and steam are employed, the end product is synthesis gas.

It is well recognized in the coal gasification art that problems arising in the operation of coal gasifiers are often connected with poor control over the solids flow distribution down the gasifier shaft, which condition is determined by the grate construction. The state of the art grate constructions provide only limited control over the discharge of solids from the grate at preselected radial positions and no grate construction known provides control over the discharge of solids from preselected sectorial positions.

U.S. Pat. No. 2,440,940—Galusha described an eccentrically stepped grate construction, the rotation of which results in ash (or other solids) gradually being dropped through the grating around the edge and between the step grates. A similar grate is also disclosed in U.S. Pat. No. 3,454,382—Hamilton. The Hamilton patent also describes the use of temperature-sensing means mounted on the grate.

The Junkers patent (U.S. Pat. No. 2,808,321) is directed to a rotating grate construction provided at its underside with sector-shaped compartments adapted to receive independently controllable flows of a gasification medium in order to maintain a uniform reaction rate in the charge over the cross-section of the producer shaft.

It would, therefore, be of particular advantage, and is an object of this invention, to provide grate construction which makes possible improved control over solids discharge at preselected radial positions whereby the by-pass of unburned carbon through the grate is substantially reduced.

DESCRIPTION OF THE INVENTION

Symmetrical stepped grate/rabble arm combinations for use in a fixed bed coal gasifier are shown in which the stepped grates comprise step plates having in combination therewith means for controlling the rate of discharge of solids therefrom. The solids discharge controlling means described comprise adjustable mechanical dams at spaced locations along the step plate periphery together with means for the positioning thereof. By effecting various positionings of the solids discharge controlling means at particular edge regions of the plate (e.g., adjustable mechanical dams) during operation, the ash or other solids can be made to leave via plate edge regions or to remain on any given step plate, or sector thereof. This capability makes it possible to predetermine along which of several radial locations solids discharge from the grate will occur during a given period of operation and the extent of the discharge area. As a result, the operator is provided with another control mechanism over the downward solids flow in the producer shaft of the gasifier.

BRIEF DESCRIPTION OF THE DRAWING

The subject matter of the instant invention for which protection is sought is presented as claims at the conclusion of the written description of the invention set forth herein. The description sets forth the manner and process of making and using the invention and the accompanying drawing forms part of the description for schematically illustrating the invention and the best mode. The view shown in FIG. 1 schematically illustrates the first embodiment of grate construction according to the instant invention in a coal gasifier;

MANNER AND PROCESS OF MAKING AND USING THE INVENTION

Figure 1:
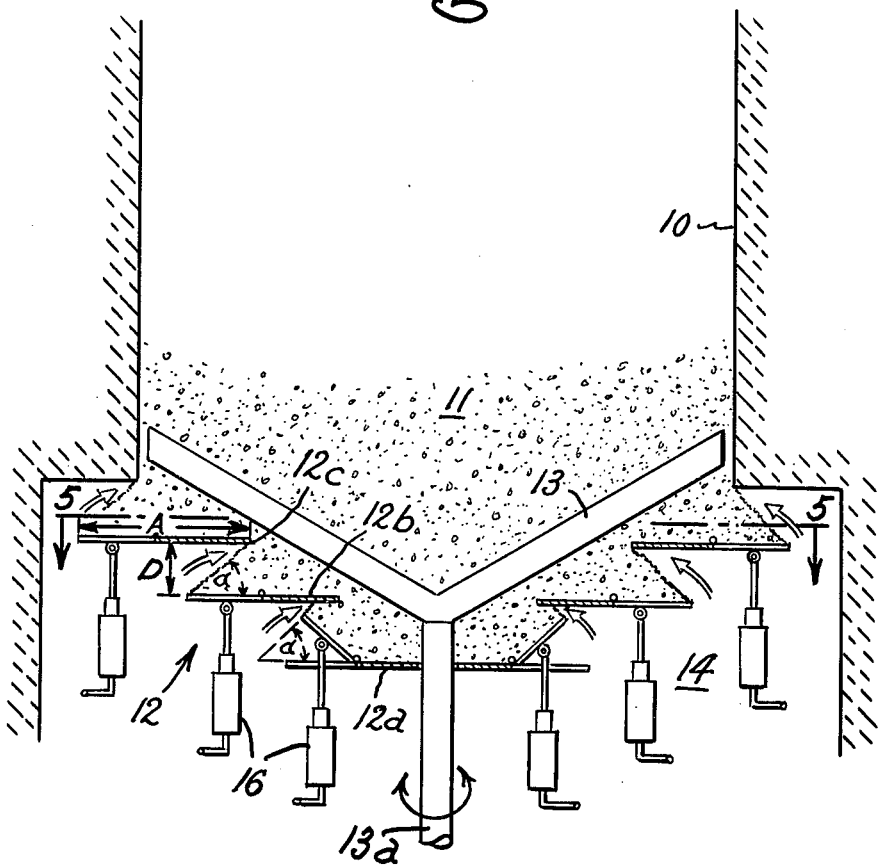
Figure 2:
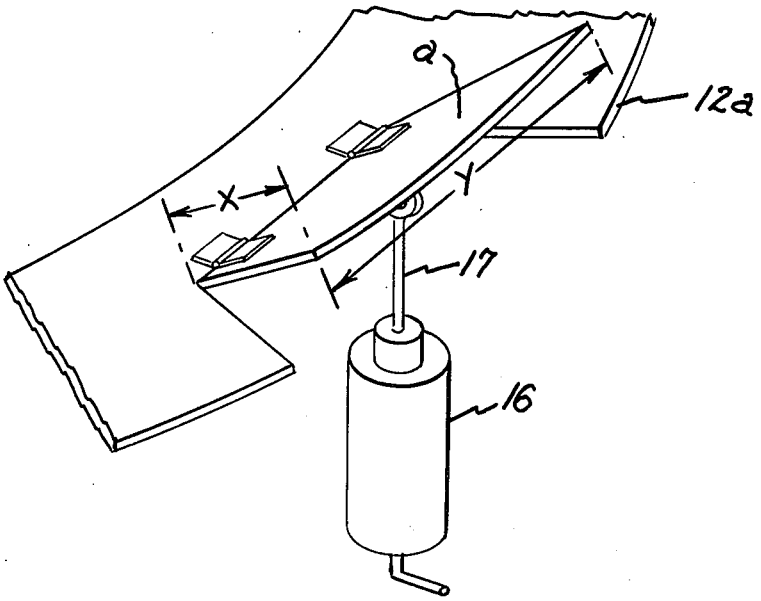
FIG. 2 presents a three-dimensional view showing one of the means for controlling the rate of solids (e.g., ash) discharge from the grate by providing a barrier of controlled attitude in order to accommodate the requisite angle of repose for the ash.
Figure 3:
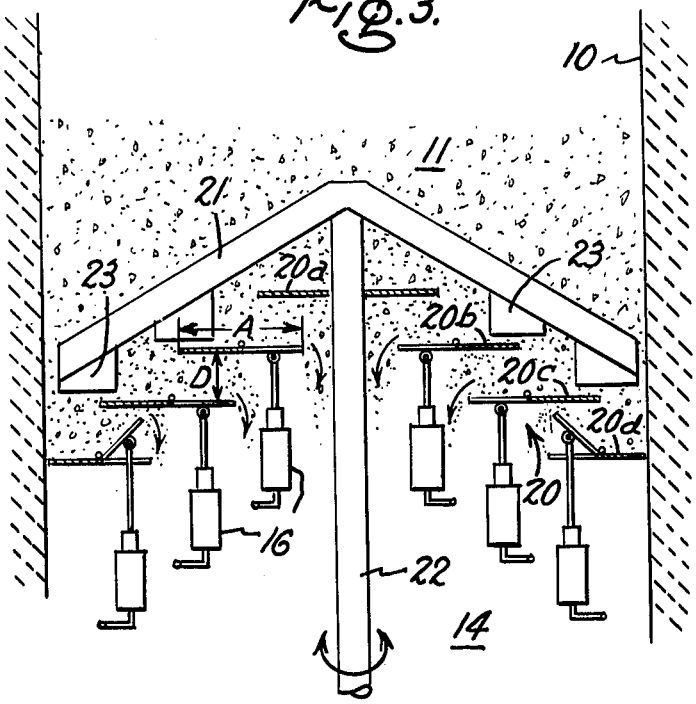
FIG. 3 schematically illustrates the second embodiment of grate construction according to this invention.

The gasifier housing shown in FIGS. 1 and 3 consists of wall 10, which may be a ceramic lining within a metal housing, or the wall construction may use a pair of spaced walls, which together define a cooling wall jacket. Only the lower portion of the gasifier and the coal bed 11 contained therein is shown, bed 11 being supported on the stepped grate construction.

In FIG. 1 grate 12 is composed of a series of generally concentric annular plates **12*a*, 12*b* and 12*c* disposed in a stepped arrangement with the largest outer diameter plate 12*c* at the top level and the smallest outer diameter plate 12*a*** at the bottom level. Each of the plates overlaps the next lower plate to some extent as shown.

Rabble arm 13, which is centrally located with its supporting shaft **13*a* extending upwardly through the arrangement of annular plates comprising grate 12, is adapted for both rotational and vertical movement for the raising and lowering thereof to facilitate operation in two modes. When in the lower position, rotation of the rabble arm 13 promotes the discharge of ash through any available open space between adjacent plates as it rotates and between a plate (e.g., plate 12*c*) and adjacent construction. In the raised position, rabble arm 13 can be used to agitate the bed under the combustion zone. The V-shape of rabble arm 13 facilitates its cooperative action with the step plates of stepped grate assembly 12**.

The air/stream or oxygen/steam input (not shown) to the gasifier may be pre-mixed as it enters undergrate plenum 14, or may be introduced into plenum 14 as separate flows. The gases so admitted move upwardly through the grate construction and its cover of ash or other solids for movement into bed 11 generally as shown by the upwardly directed arrows.

Figure 5:
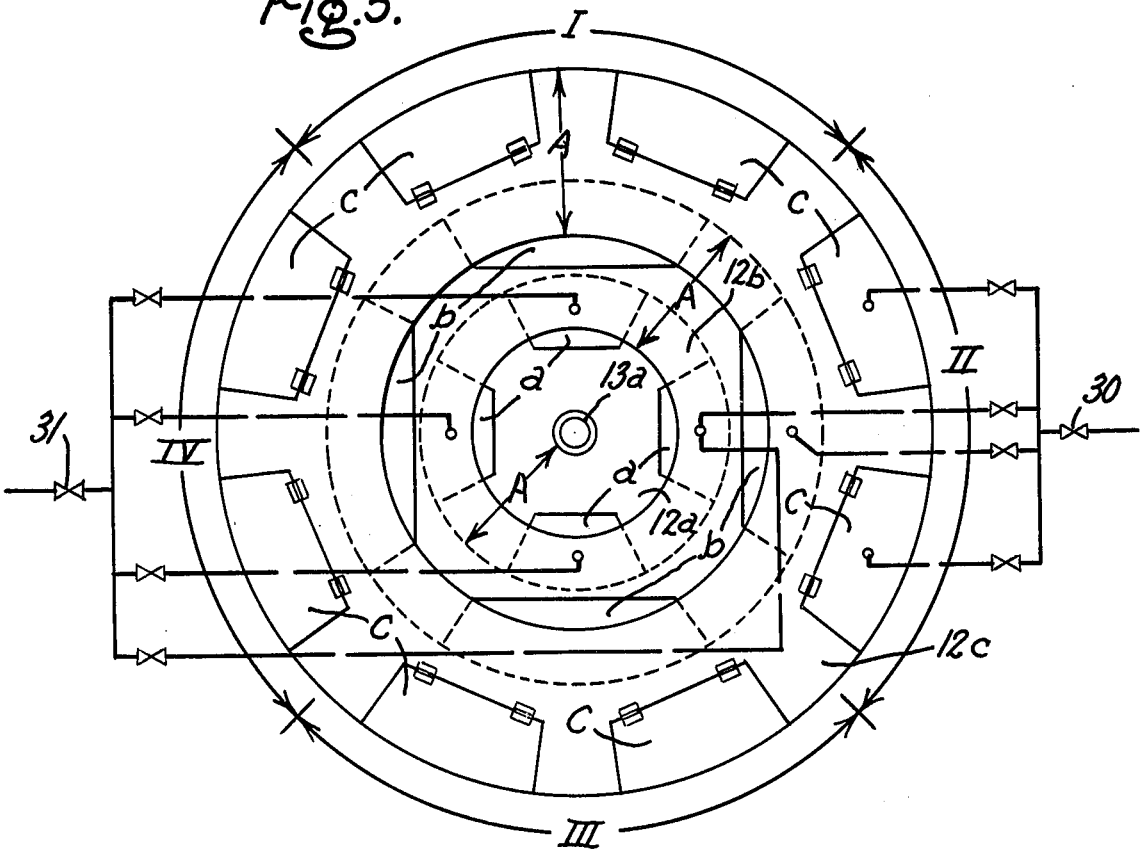
FIG. 5 schematically illustrates control arrangements for the solids discharge controlling means.

Each of the several annular plates 12*a*, 12*b*, 12*c* is provided with a plurality of controllably positionable flap, or dam, members around the outer periphery thereof. As shown in FIG. 5 dams in step plate 12*a* are designated as a; dams in step plate 12*b* are designated as b and dams in step plate 12*c* are designated as c. Preferably each dam is sufficiently long so that it can be pivoted about its hinged connection upwardly far enough to engage the underside of the plate or construction located thereabove. Positioning of each dam in positions other than horizontal is accomplished by means of a hydraulic cylinder actuating device 16 provided for each dam. Stub shaft 17 of device 16 is adapted to move a given dam upwardly to the extent desired up to a position of maximum deflection at which the dam engages the underside of the plate or construction thereabove.

The upper plate 12*c* of the inverted series of grate plates in grate assembly 12 is disposed where wall 10 overhangs the periphery thereof such that flaps c will coact with the underside of wall 10.

Thus, as rabble arm 13 rotates in its lower position solids (e.g., ash) are discharged between the plates at the rate fixed by the rate of rotation and the particular disposition of the various dams as will be described in greater detail below. Further, the preselectability of the deflection position to be assumed by particular dams at the command of the operator enables programming of solids discharge from those radial positions in the bed where these mechanical dams have been located.

The profiles of solid particulate matter on grate plates 12*a*, 12*b*, 12*c* shown in FIG. 1 represent a static condition (i.e., no rotation of rabble arm 13 to urge the discharge of solids from the grate). Under such conditions solids will leave each grate plate at its outer periphery until the angle of repose $\alpha$ is reached. When the discharge of solids is actually in progress, the "throttling down" of all (or part) of the throat area between a pair of plates, or between a plate and the construction above, will prevent (or reduce) solids discharge through that throat area diverting the solids elsewhere for discharge. The vertical distance between step plates is designated by dimension D and the width of a given annular plate is designated A. Dimension D should be less than or equal to dimension A. The dams should be spaced apart at least a distance equal to D and dimension X should be at least equal to D. Dimension Y may be in the range of from 2D to about 10D.

Grate parts, the rabble arm and the supporting shaft therefor, as well as the supporting members for locating and maintaining the grate plates where shown in the drawing may be conveniently formed of cast steel. The grate plate supporting members are not shown in either FIGS. 1 or 3 so as not to unnecessarily complicate the drawing.

Actuating device 16 is preferably hydraulically driven and arrangements for the controlled supply of hydraulic fluid thereto is described hereinbelow in connection with the description of FIG. 5. Suitable hydraulic fluid (e.g., 600° F. steam turbine journal bearing hydraulic fluid) is commercially available. Also, if desired, the actuator devices can be cooled, isolated or insulated for the protection thereof. Although a hydraulic system is preferred, an electrical system (e.g., employing servomotors with worm gears) is also contemplated and has the advantage of providing position feedback.

The operator is provided with the requisite information for arriving at a decision as to which dams, if any, are to be repositioned by temperature sensors (not shown) properly located in the wall of the producer shaft or affixed to the grate plates.

FIG. 3 sets forth another embodiment in which stepped grate 20 has the step plate members 20*a*, 20*b*, 20*c*, 20*d* stacked in a truncated multi-level conical shape with the smallest diameter plate 20*a* at the top level (i.e., the reverse of grate 12). Also, in contrast to grate 12 wherein ash and other solids enter radially inward of its discharge point via a given throat region (i.e., the volume generally defined by a pair of annular grate plates or between an annular grate plate and adjacent construction), in grate 20 the solids enter radially outward of its discharge point via a given throat region. For this reason the dams are disposed along an inner perimeter of each of the step plates below step plate 20*a*.

Rabble arm 21 affixed to drive shaft 22 is in the shape of an inverted-V to conform to the stacking profile and, thereby, function as means to promote the movement of solids between the step plates. Preferably, rabble arm 21 is provided with in-flow plows 23 to render the discharge more effective. Dam dimensions, spacings and operation will be as recited for the first embodiment. Dam actuators are designated 16 as in the first embodiment and other identical numerals represent the same structural arrangements as in FIG. 1.

Figure 4A:
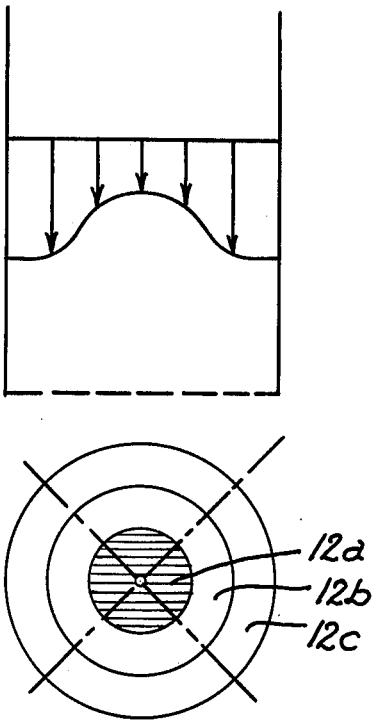
FIG. 4 illustrates several operating modes in views 4A, 4B and 4C that can be instituted by various settings of the solids discharge controlling means of this invention.
Figure 4B:
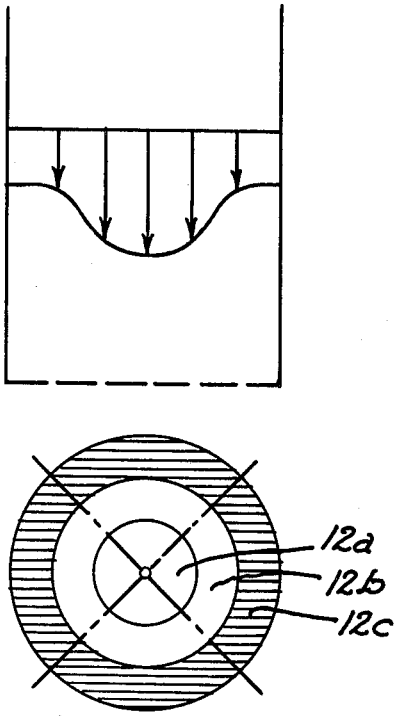
Figure 4C:
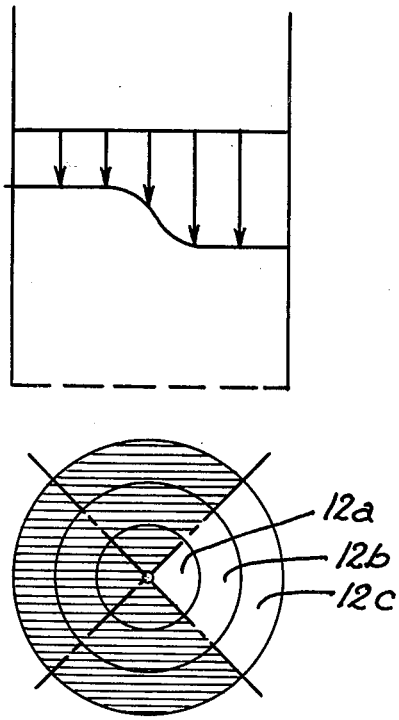

FIG. 4 sets forth several ways in which the operator may utilize the damming action to divert solids discharge from one throat volume to another throat volume of grate 12 or grate 20 and thereby exercise control over the downwards solids flow in the producer shaft. While the specific description provided refers to the use of grate 12, grate 20 will operate to provide the same general principles of control. Each of FIGS. 4A and 4B consists of a symmetrical velocity profile for solids flow down the producer shaft and directly below each profile is a simplified designation of grate 12. The shaded grate plates represent in each instance those grate plates on which all of the dams 16 have been actuated to restrict or block the throat volume controlled thereby in order to produce the velocity profile thereabove. FIG. C is representative of sectorial control and the velocity profile is not indicative of a symmetrical profile, but rather is representative of the velocity profile that can be achieved in a plane passing through the undammed quadrant sector as, for example, is shown unshaded in the grate designation for FIG. 4C. Referring, for example, to FIG. 5 for illustrative quadrant and dam designations, all dams in sectors I, III and IV will have been actuated to restrict, or block, the throat volume controlled thereby to provide the operational mode of FIG. 4C.

FIG. 5 is a sectional view taken on line 5—5 of FIG. 1 (with rabble arm 13 raised up) schematically setting forth control arrangements for both radial and sectorial control of dam positioning. No attempt has been made to set forth the hydraulic line and control valve for each of the dams shown, but it is intended that provisions be made for operation and control of each dam. Collective radial and/or sectorial control may then be superimposed thereon. Thus, hydraulic lines for the dams shown selected from all three step plates as grouped will enable the operator to actuate the dams in the entirety of quadrant II with valve 30 assuming the valves for the individual grouped dams are open. In the same fashion hydraulic lines for all the dams on step plate a are shown grouped so that the operator will be able to actuate all those dams by means of valve 31 providing the valves for each of the dams in that group are open. Those groupings are representative and a larger or smaller number of sectorial portions may be selected.

Although substantially flat annular plates have been illustrated and are preferred, the term "generally annular" should be understood to encompass plates having a truncated conical surface where the cone angle is large.

BEST MODE CONTEMPLATED

The preferred arrangement is that schematically illustrated in FIG. 1 for which additional controls have been provided enabling both radial and sectorial groupings of the respective dams. Hydraulic control is to be employed to position the dams in the desired flow restricting posture.

What I claim as new and desire to secure by Letters Patent of the United States is:

1. In a process for producing a fuel gas from coal by subjecting the coal to carbonization and then to reduction as it moves by gravity down a shaft, with the solids remaining at the lower end of said shaft being removed from the gasification process by passage through a multi-level grate structure, the improvement comprising the steps of:

employing as part of the multi-level grate structure a plurality of vertically spaced generally parallel plate members generally annular in shape, restricting via adjustable means for a controllable length of time at a given annular plate member the flow of solids from said plate member at edge regions thereof, the edge regions to be restricted being selected during operation, and simultaneously discharging solids from the balance of the edge regions of said plate member thereby controlling the downward solids flow in the shaft of the gasifier.

2. The improvement recited in claim 1 wherein solids discharge from the edge regions of the given plate member is sectorial in configuration.

* * * * *